United States Patent [19]

Ylitalo

[11] 3,946,518

[45] Mar. 30, 1976

[54] TOY STICK AMUSEMENT DEVICE

[76] Inventor: Howard M. Ylitalo, Rte. 2, Box 101, Cokato, Minn. 55321

[22] Filed: Nov. 11, 1974

[21] Appl. No.: 522,512

[52] U.S. Cl. ..... 46/47; 46/51
[51] Int. Cl.[2] ..... A63H 1/32
[58] Field of Search ..... 46/47, 51

[56] References Cited

UNITED STATES PATENTS 3,545,121 12/1970 Misko ..... 46/47

FOREIGN PATENTS OR APPLICATIONS 648,219 1/1951 United Kingdom ..... 46/47

317,404 7/1930 United Kingdom ..... 46/47

*Primary Examiner*—Louis G. Mancene
*Assistant Examiner*—Robert F. Cutting
*Attorney, Agent, or Firm*—Leo Gregory

[57] ABSTRACT

A toy stick amusement device comprising an elongated cylindrical stick, an annular rib about said stick spaced from one end thereof to provide a handle portion of said stick and forming a stop member thereon, an annular rib adjacent the other end of said stick forming a stop member, a ring member about said stick having sufficient clearance therebetween for said ring to twirl freely about said stick and travel thereon between said stop members.

1 Claim, 4 Drawing Figures

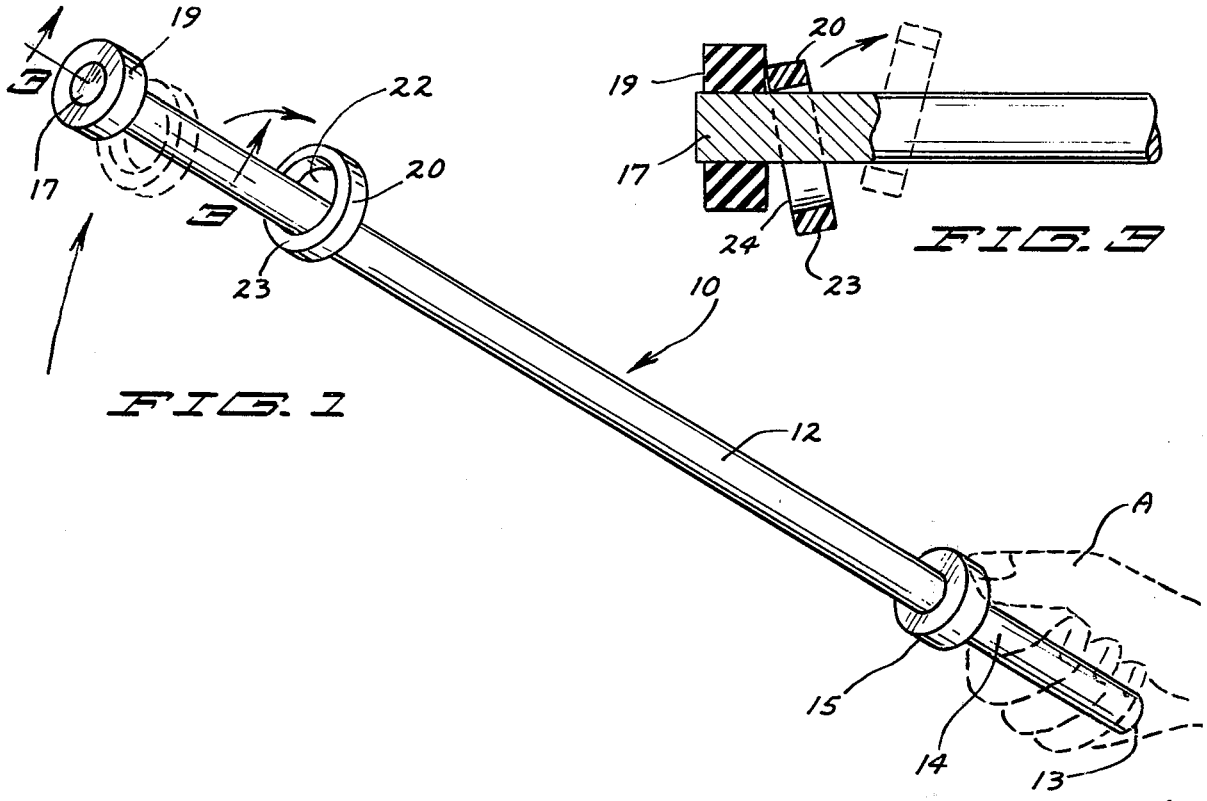
FIG. 1
FIG. 3
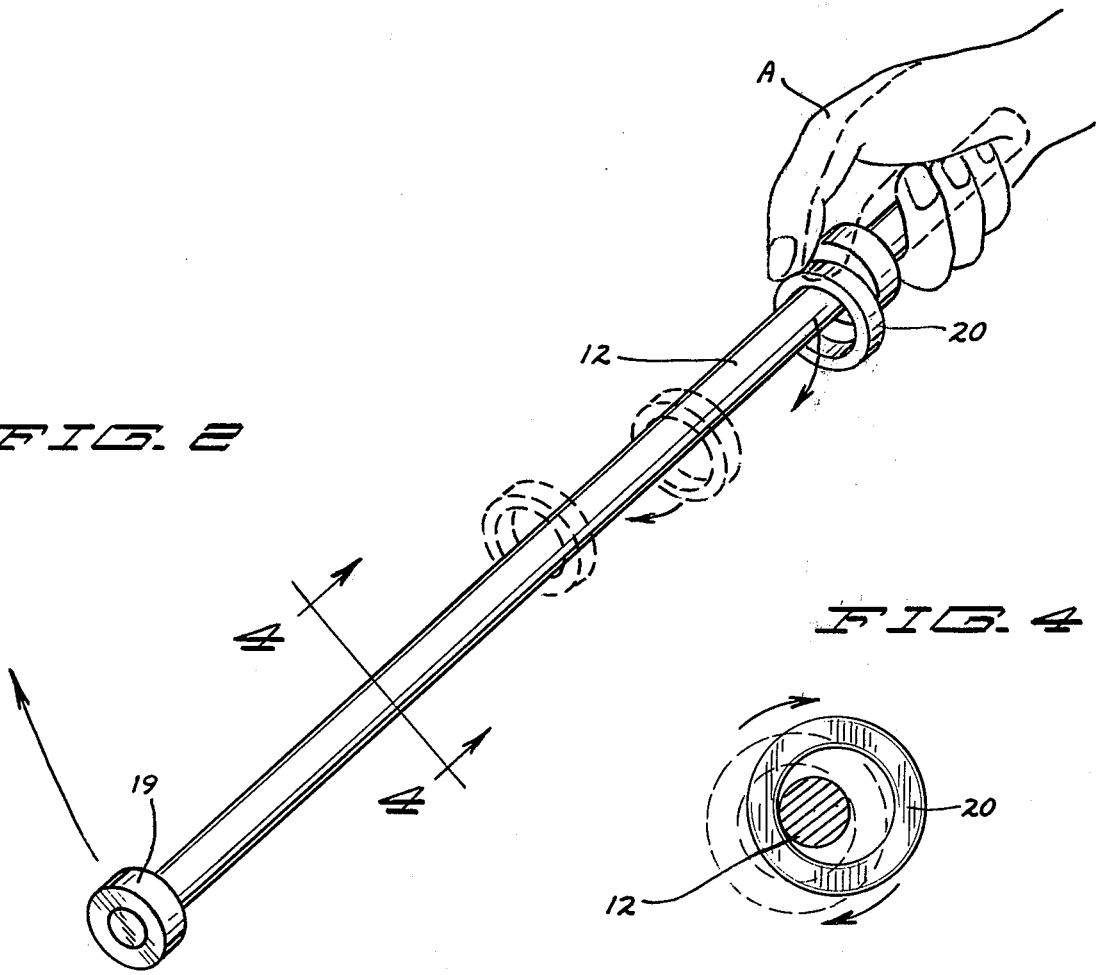
FIG. 2
FIG. 4

TOY STICK AMUSEMENT DEVICE

BACKGROUND AND SUMMARY OF THE INVENTION

This invention relates to a toy stick device comprising a stick having a ring disposed thereon with clearance therebetween which with the exercise of requisite skill may be made to twirl about said stick and travel axially forwardly and rearwardly thereof with a downward and upward tilting of said stick, said stick having a pair of spaced stop members thereon to reverse the direction of travel of said twirling ring.

A related toy device is disclosed in the British Pat. No. 317,464, dated July 17, 1930, and issued to Walter Real. This patent discloses in its preferred embodiment an endless circular wire having a disc thereon to be rotated thereon for continuous travel in one direction. As the modification of the circular wire, the inventor suggests that a straight wire may be used and such a wire is shown being unobstructed for its entire length. It is difficult to twirl such a ring about such a wire for travel thereon and for reversing the direction of travel of such ring without having the ring run or travel off the end of the straight wire. It is conceivably possible to do so, but to accomplish this is very difficult and would appear to make the toy device impractical and unworkable.

The structure herein embodies an improvement over what is disclosed in the British patent and makes the toy a workable toy. The structure herein includes bumpers or stop members at the free end of the stick and adjacent the handle end portion thereof whereby the ring member in being twirled along the stick is made to reverse direction of travel by engagement with said stop members. As simple as this improvement may appear to be, there does not appear to be any teaching or disclosure in the art to indicate such an improvement. Hence, this relatively simple unobvious structural improvement makes what is disclosed in the British patent into a practical operable toy for which the requisite skill for its operation may be readily acquired.

It is an object of this invention therefore, to provide a very practical toy stick device which for its successful operation develops skill in coordination and timing on the part of the operator.

It is another object of this invention to provide a toy stick device having a ring mounted thereon to be twirled thereabout for forwardly and rearwardly travel thereon with the application of requisite skill.

More specifically stated, it is an object of the invention herein to provide a toy stick device having a ring disposed on a stick having sufficient clearance thereabout to be freely twirled thereabout and a pair of annular ribs spaced axially of said stick forming step members whereby the direction of travel of said ring when twirling along said stick may be reversed between said stop members by engagement therewith and a handle portion is provided at one end of said stick outwardly of the adjacent stop member.

These and other objects and advantages of the invention will be set forth in the following description made in connection with the accompanying drawings in which like reference characters refer to similar parts throughout the several views and in which:

FIG. 1 is a view in perspective showing one operating position of the invention herein;

FIG. 2 is a view similar to FIG. 1 showing a second operating position;

FIG. 3 is a broken view in longitudinal section on a somewhat enlarged scale taken on line 3—3 of FIG. 1 as indicated; and FIG. 4 is a view in transverse section on a somewhat enlarged scale taken on line 4—4 of FIG. 2 as indicated.

DESCRIPTION OF A PREFERRED EMBODIMENT

Referring to the Figs., the device 10 comprising the invention herein is shown consisting of an elongated stick 12 which in the present embodiment is indicated as being cylindrical in form. Said stick may be formed of any suitable material such as of wood or an extruded plastic and may vary as to length as may be desired.

Secured to or formed about said stick 12 spaced from one end 13 thereof to form a handle portion 14 is an annular rib or collar 15 forming a stop member. Said stop member may be rigid or resilient although it is desirable to have said stop member be somewhat resilient.

Located at and secured to the other end 17 of said stick is a stop member 19 similar to said stop member 15. It will be appreciated that the spacing between said stop members may vary as may be desired but preferably there will be a substantial length of stick between said stop members.

Disposed on said stick is a ring member 20 preferably formed of a somewhat resilient material and having an opening or bore 22 therethrough with said bore having a diameter such as to permit said ring member to have a free twirling movement thereabout. Said ring has an annular wall 23 having, as shown here, an inner surface 24 shown here as being flat in width but it may be formed to have a transverse radius.

Preferably, the adjacent surfaces of said stick and of said ring member will be non-slick surfaces and will be sufficiently non-slick such that the ring will have an adequate grip or purchase upon the surface of said stick, as indicated in FIGS. 3 and 4, to travel thereon by a twirling action as will be described and to avoid a tendency to slide along said stick so as to negative the twirling action.

It will be appreciated that the stick and ring may be variously decorated to enhance the appearance of the device in operation.

OPERATION

As indicated in FIGS. 1 and 2, the stick 12 will be gripped by a hand A about its handle portion 14 and the stick will be tilted downwardly as indicated in FIG. 2. Simultaneously, with the downward tilt of the stick, the ring will be given a twirling impulse by the thumb of the operator or a twirling impulse may be imparted to the ring by a sharp downward tap of the stick on a solid surface as the ring is simply released by the thumb of the operator. The ring in a twirling or spinning motion will travel downwardly of said stick to the point of contact with said stop member 19.

At the instant of contact between said ring and said stop member, said ring will in effect rebound from said stop member and at that same instant with requisite skill the operator will tilt the stick upwardly and without a break in its momentum said ring will reverse its direction of travel and maintain a twirling action about said stick to the point of reaching the stop member 14 at which point its direction of travel will again be reversed, the stick will be tilted downwardly and thus the operation above described will be repeated.

When sufficient skill has been acquired, the operator may exercise a great deal of freedom in handling the stick such as in tossing the stick upwardly on the order of a baton being tossed by a baton twirler with the ring being maintained in its twirling action throughout the flight of the stick. With more than one person operating said sticks, said persons may, with the exercise of requisite skill, toss the sticks from one to another in maintaining the rings in twirling action and there are other feats of skill which may be exercised.

Said ring in twirling defines a helical path of travel about said stick and had a line engagement with said stick as it moves thereabout. Hence, with the ring and stick preferably having non-slick engaging surfaces, the ring has sufficient purchase or grip upon the stick at its consecutive points of engagement to have a fairly constant rate of travel along the stick as controlled by the angle of tilt thereof.

Thus it is here provided a toy stick device which in its operation results in the development of various manual skills and coordination and a significant degree of interest is generated in its operation.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A toy stick device comprising an elongated stick member, a ring member having a small wall thickness having an arcuate outer surface in cross-section and having a flat inner wall surface in cross-section, said ring member having a bore of a diameter of sufficient size to provide a free twirling movement of said ring about said stick, a resilient substantially spherical stop member at one end of said stick, said member being sufficiently resilient for a rebound of said ring member from said stop member upon engagement therewith, an annular collar forming a stop member secured about said stick spaced from the other end thereof and being of like resilience as said first mentioned stop member, a handle formed on said stick between said collar and the adjacent end of said stick, and said stick and the bore of said ring having non-slick engaging surfaces.

* * * * *